United States Patent [19]

Iten

[11] 4,134,339

[45] Jan. 16, 1979

[54] SCREEN-PRINTING STENCIL

[75] Inventor: Walter A. Iten, Mutschellen, Switzerland

[73] Assignee: K. Iten AG, Rudolfstetten, Switzerland

[21] Appl. No.: 740,240

[22] Filed: Nov. 8, 1976

[30] Foreign Application Priority Data

Nov. 10, 1975 [CH] Switzerland ..... 14535/75

[51] Int. Cl.[2] ..... B41F 15/36

[52] U.S. Cl. ..... 101/127

[58] Field of Search ..... 101/127, 128.2, 128.3, 101/128.4; 428/131, 134, 132, 135, 908; 118/504; 33/174 B, 174 G

[56] References Cited

U.S. PATENT DOCUMENTS 1,600,229 9/1926 Heidman ..... 101/127 X 1,653,450 12/1927 Carroll ..... 33/174

2,278,771 4/1942 Csaszar ..... 101/129

FOREIGN PATENT DOCUMENTS 2542430 1/1976 Fed. Rep. of Germany ..... 101/127

*Primary Examiner*—Ronald E. Suter

*Attorney, Agent, or Firm*—Wenderoth, Lind & Ponack

[57] ABSTRACT

A screen-type printing stencil has therein plural openings arranged in an overall pattern which is formed by the repetition of the arrangement or location of a pattern period or primary or basic pattern. The pattern period includes at least two differently shaped openings. No two openings of a given pattern period may be brought into coincidence or superimposition with each other upon the rectilinear shifting or translation of one with respect to the other.

4 Claims, 2 Drawing Figures

SCREEN-PRINTING STENCIL

BACKGROUND AND SUMMARY OF THE INVENTION

The present invention relates to a screen-type printing stencil having therein holes arranged in a pattern.

Screen printing, whether of the type employing flat-bed printing stencils or of the type employing cylindrical screen printing stencils in rotary screen printing machines, requires that the boundary areas between the different printed colors be smeared as little as possible.

The object of the present invention is accordingly to provide a screen-type printing stencil having therein openings patterned to reduce smearing.

This object is achieved according to the present invention by providing that the pattern of the openings or holes is formed by repetition of a primary pattern or pattern period formed by at least three holes none of which can be brought into coincidence or superimposition by rectilinear shifting toward each other.

In this connection it is of advantage if the pattern period includes holes of at least two different geometrical shapes and/or different sizes.

A particularly advantageous embodiment of a screen-type printing stencil according to the present invention is obtained when the pattern period has at least one hole which is equilateral and at least two elongated holes or six pentagonal holes.

When at least two elongated holes are provided, it is advantageous if the equilateral hole is hexagonal and if there are present three elongated, congruent, rhomboidal holes, the longitudinal axes of which extend at an angle of 60° with each other. The sides of each rhomboidal hole extend in directions parallel with respective sides of the hexagonal hole.

When six pentagonal holes are provided, it is of advantage that the equilateral hole be a regular hexagon and that the six pentagonal holes be shifted with respect to each other by 60° symmetrically around the hexagonal hole. Each side of the hexagonal hole faces a parallel side of equal length of one of the pentagonal holes. The mutually facing sides of adjacent of the pentagonal holes are always parallel with each other, and the outer sides adjacent thereto are always aligned with each other and jointly form a regular hexagon.

The above features of the screen-type printing stencil of the invention avoid the occurrence of intervals, which would otherwise exert a disadvantageous effect on printing, especially the printing of fine line patterns.

Further, a particular advantage of the invention is that the screen-type printing stencils of the invention produce sharper pattern outlines, since the inner tensions of the photolacquer exert their effect in an advantageous manner, i.e. the photolacquer does not pull back in the area of holes, which would lead to irregular edges.

BRIEF DESCRIPTION OF THE DRAWINGS

The following text describes in more detail two exemplified embodiments of the invention with reference to the attached drawings, wherein.

DETAILED DESCRIPTION OF THE INVENTION

Figure 1:
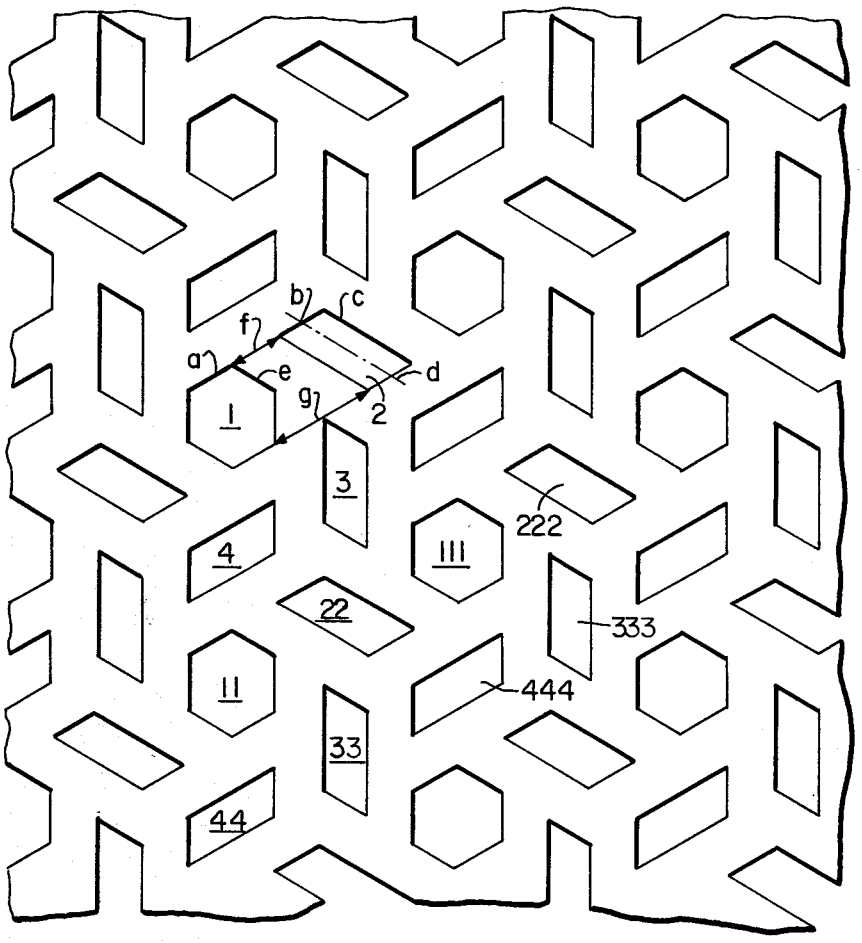
FIG. 1 is a schematic view illustrating a first embodiment of the invention.

FIG. 1 shows a pattern according to a first exemplified embodiment of the invention. A screen stencil has therein plural openings arranged in an overall pattern formed by repetition of a pattern period or a primary pattern. For example, the pattern period may be formed by openings or holes 1, 2, 3 and 4. The entire or overall hole pattern of the stencil is formed by shifting the location of the pattern period formed by holes 1, 2, 3 and 4 over the surface of the stencil. For example, the pattern period designated by reference numerals 1 to 4 can be shifted downwardly with respect to FIG. 1 by a distance equal to the period dimension to form holes 11, 22, 33 and 44. The pattern period can also be shifted to the positions of holes 111, 222, 333 and 444. The complete overall hole pattern of the stencil is produced through further such displacements of the basic pattern period.

None of the holes of a pattern period, and particularly none of the holes 2, 3 and 4 that possess the same shape, can be brought into coincidence or superimposition by rectilinearly shifting one toward the other. It is obvious that superimposition would require, in the arrangement of FIG. 1, shifting or displacement effected along an arc of a circle having a center coinciding with the center of hole 1.

However, it is not necessary to select holes 1, 2, 3 and 4 as the particular pattern period. A pattern period could aslo consist of holes 11, 222, 444 and 3. Also in this case, none of holes 222, 444 and 3 can be made to coincide upon a rectilinear shifting of one toward the other. Holes 1, 11 and 111 of the above discussed pattern periods of course cannot be made to coincide within each pattern period, since only one such hole is provided in each pattern period.

On the other hand, it is not possible to form a pattern period from, e.g. holes 11, 4, 22 and 44, since hole 4 can be made to coincide with hole 44 through rectilinear shifting. In addition, such a pattern period would not possess a hole that would correspond to the position of hole 33, and consequently, this area would form an excessively large nonprinting surface in the screen-type printing stencil.

The pattern period shown in FIG. 1 includes a single equilateral hole 1, 11 or 111, which has the shape of an equilateral hexagon. Such hole, e.g. 1, is associated with three additional, simiarly shaped holes 2, 3 and 4, each of which is elongated and has the shape of a rhomboid. The length of each shorter side b of each rhomboid equals the length a of each side of the equilateral hexagon, and the length of each longer side c of each rhomboid equals twice the length a of each side of the equilateral hexagon. Further, longitudinal axis d of each rhomboid extends at an angle of 60° with the longitudinal axis of each adjacent rhomboid.

Each shorter side b of each rhomboid is colinear with a pair of parallel sides a of the hexagon. Each longer side c of each rhomboid extends in a direction parallel with a pair of parallel sides e of the hexagon. The distance between each rhomboid and the hexagon is selected such that a distance f, between the end of side a of the hexagon which is closest to the rhomboid and the end of side b of the rhomboid which is closest to the hexagon, equals a, which also equals b. Accordingly, the distance g is equal to twice a, or twice b.

Any straight line which extends through the present pattern is repeatedly intersected by the hexagonal or rhomboidal holes. In borderline cases such straight line is situated precisely on the side lines of the figure. Consequently, the boundary area between different colors is printed much sharper than was possible in previous arrangements.

Figure 2:
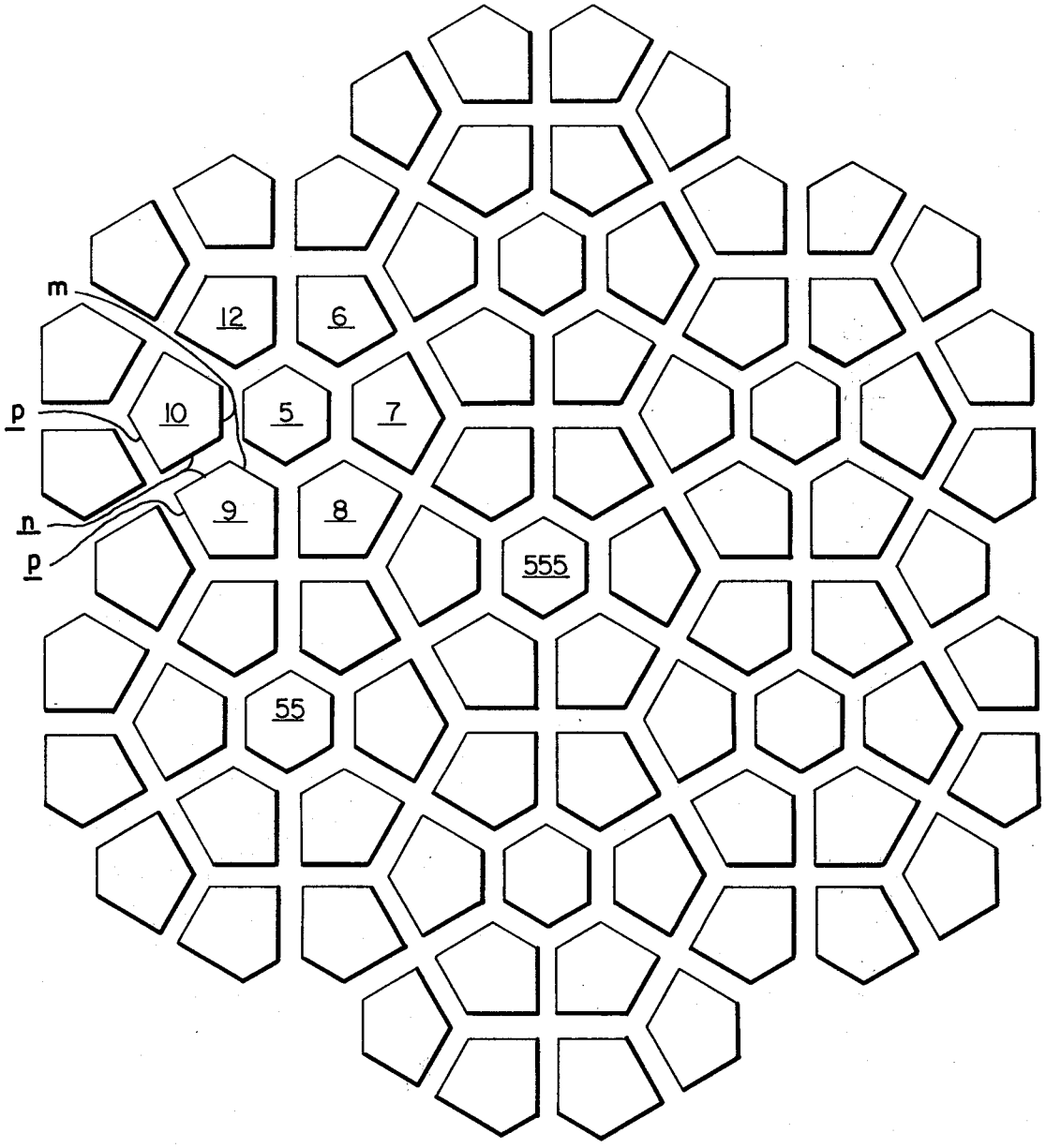
FIG. 2 is a schematic view illustrating a second embodiment of the invention.

FIG. 2 shows a further exemplified embodiment of a screen-type printing stencil according to the invention. A pattern period is formed by an equilateral hole 5, 55 or 555 (an equilateral hexagon in FIG. 2) that is symmetrically surrounded by six pentagonal holes, e.g. holes 6, 7, 8, 9, 10 and 12 surrounding hole 5, the alignment of each of which is shifted by 60° in relation to each other. Each side of the hexagonal hole is faced by a parallelly extending and equal length side m of a respective one of the pentagonal holes. The mutually facing sides n of the adjacent pentagonal holes always extend in parallel with each other, thus producing intervals of identical width between adjacent of the pentagonal holes. The outer sides p of adjacent pentagonal holes which are adjacent to such mutually parallel sides n are always colinearly aligned with each other, so the outer outline of the pattern period formed by the six pentagonal holes that surround the hexagonal hole again forms a regular hexagon.

Essential features of this embodiment are that the intervals between adjacent pentagonal holes are equal, and that the intervals between the hexagonal hole and the pentagonal holes are equal.

I claim:

1. In a screen-type printing stencil of the type having therein plural holes through which passes printing material during a printing operation, the improvement wherein:

said plural holes are arranged in an overall pattern which is formed by the repetition of the arrangement of a primary pattern, said primary pattern comprising at least three holes, said holes of said primary pattern comprising one hole having the configuration of an equilateral polygon and at least two elongated holes, said holes of said primary pattern being arranged with respect to each other such that no two of said holes may be brought into coincidence or superimposition with respect to each other upon the rectilinear shifting of one with respect to the other.

2. The improvement claimed in claim 1, wherein said one hole comprises a hexagonal hole, and wherein said elongated holes comprise three equally shaped rhomboidal holes, each said rhomboidal hole having a longitudinal axis, said rhomboidal holes being arranged such that said longitudinal axes thereof extend at angles of 60° with respect to each other, and such that each of the sides of each said rhomboidal hole extend in a direction parallel with a respective side of said hexagonal hole.

3. In a screen-type printing stencil of the type having therein plural holes through which passes printing material during a printing operation, the improvement wherein:

said plural holes are arranged in an overall pattern which is formed by the repetition of the arrangement of a primary pattern, said primary pattern comprising one hole having the configuration of an equilateral polygon and six pentagonal holes, said holes of said primary pattern being arranged with respect to each other such that no two of said holes may be brought into coincidence or superimposition with respect to each other upon the rectilinear shifting of one with respect to the other.

4. The improvement claimed in claim 3, wherein said one hole comprises a hexagonal hole, and wherein said six pentagonal holes are equally spaced around said hexagonal hole, with the alignment of each said pentagonal hole being shifted by 60° with respect to adjacent of said pentagonal holes, each side of said hexagonal hole being faced by an inner side of a respective one of said pentagonal holes, each said pentagonal hole inner sides extending parallel to and having the same length as the respective facing side of said hexagonal hole, adjacent of said pentagonal holes having mutually facing sides which extend in directions parallel with each other, adjacent of said pentagonal holes having outer sides adjacent said mutually facing sides which are colinearly aligned, and said outer sides of said pentagonal holes jointly forming a regular hexagonal configuration.

* * * * *